United States Patent [19]

Bynoe

[11] 4,024,681

[45] May 24, 1977

[54] FLASHING SYSTEM

[75] Inventor: Robert J. Bynoe, Chagrin Falls, Ohio

[73] Assignee: Tremco Incorporated, Cuyahoga County, Ohio

[22] Filed: June 17, 1976

[21] Appl. No.: 697,229

[52] U.S. Cl. ..... 52/60; 52/94

[51] Int. Cl.[2] ..... E04D 1/36; E04B 7/00

[58] Field of Search ..... 52/58, 60, 62, 94, 72, 52/18, 741, 273, 97, 61, 169, 98, 232, 716, 222, 732; 403/295; 160/195

[56] References Cited

UNITED STATES PATENTS

| | | | |
|---|---|---|---|
| 3,132,445 | 5/1964 | Swanson | 52/94 |
| 3,365,847 | 1/1968 | Josek | 52/58 X |
| 3,410,038 | 11/1968 | Göbel | 52/62 |
| 3,444,658 | 5/1969 | Göbel | 52/60 X |
| 3,448,902 | 1/1970 | Göbel | 52/60 |
| 3,488,901 | 1/1970 | Peterschmidt | 52/81 |
| 3,562,971 | 2/1971 | Göbel | 52/60 |
| 3,686,803 | 8/1972 | Göbel | 52/94 X |
| 3,719,013 | 3/1973 | Blick | 52/732 X |
| 3,731,439 | 5/1973 | Hickman | 52/62 X |
| 3,793,795 | 2/1974 | Annand | 52/61 |

FOREIGN PATENTS OR APPLICATIONS

| | | | |
|---|---|---|---|
| 615,153 | 6/1935 | Germany | 52/60 |

*Primary Examiner*—Price C. Faw, Jr.
*Assistant Examiner*—Robert C. Farber

[57] ABSTRACT

A flashing system for weatherproofing the areas between adjoining structural surfaces which are continually exposed to ambient conditions. A longitudinally extending bracket member is adapted to be secured to a structural surface such as a building parapet or the like. The bracket includes a longitudinally extending opening. A sheet of flexible material (preferably elastomeric) material is supported by the bracket member and covers selected areas between the adjoining surfaces. The sheet of flexible material extends through the opening in the bracket, and a stiffening member in the form of a longitudinally extending planar member has a portion secured to the sheet of flexible material. Part of the bracket member defines a longitudinally extending track portion designed to slidably engage a longitudinal edge of the stiffening member. The combined flexible sheet and stiffening member are designed to be longitudinally inserted from one end of the bracket member with the stiffening member slidably engaging the track portion. The bracket member defines means which resists dislodgement of the stiffening member through the longitudinal opening.

8 Claims, 4 Drawing Figures

FIG.2
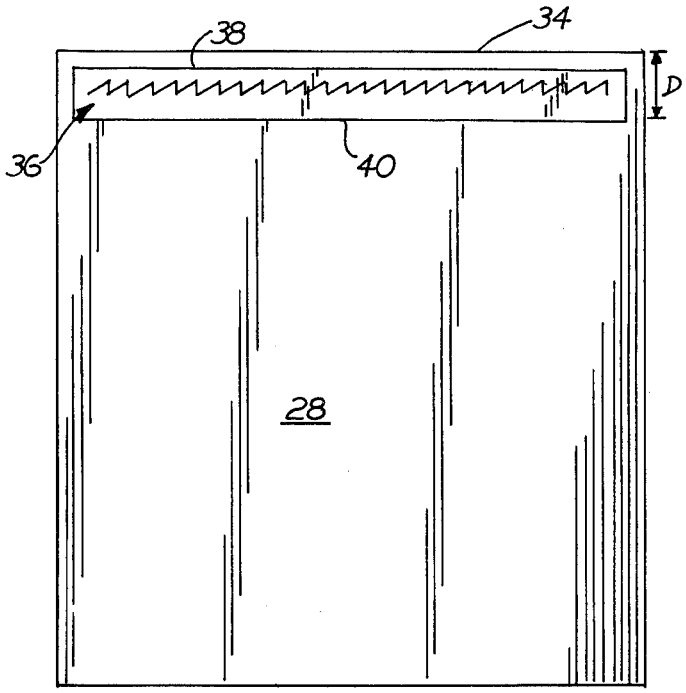
FIG.3
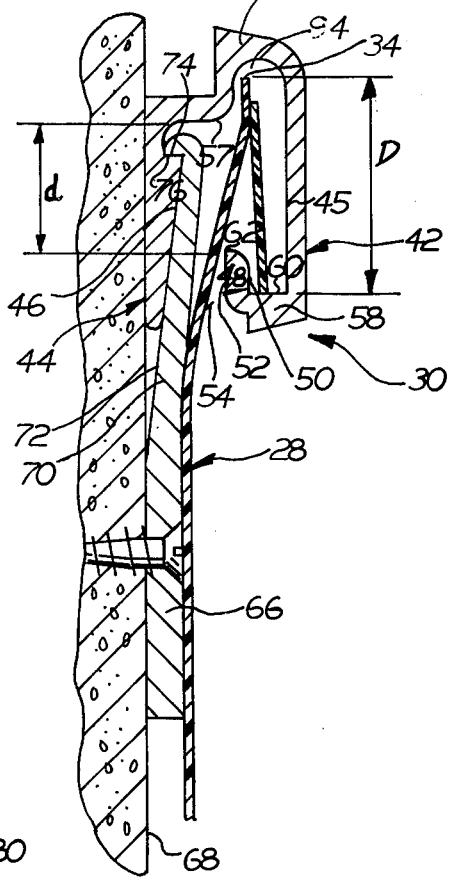
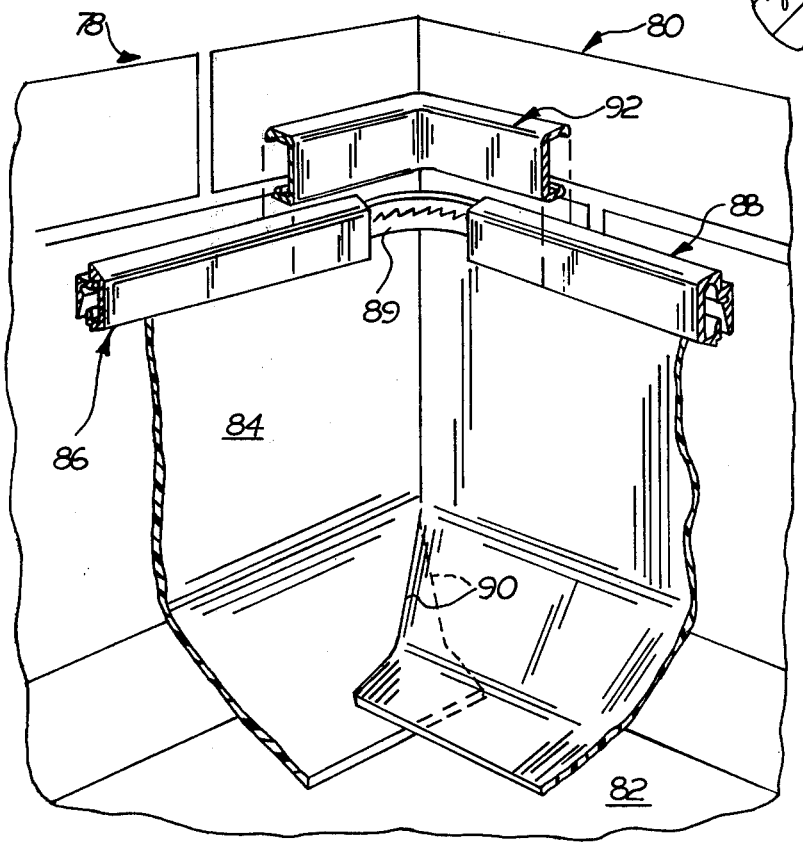
FIG.4

FLASHING SYSTEM

This application relates to a flashing or weatherproofing system of the type designed to provide a weatherproof seal between adjoining structural surfaces which are exposed to ambient conditions. It has particular application to a weatherproofing system designed to weatherproof the areas between a roof deck and a building parapet.

BACKGROUND OF THE INVENTION

Static building structures include many adjoining strctural surfaces, such as building parapets and adjoining roof decks, which are continually subjected to ambient conditions. It is well known that movement tends to occur between such surfaces, due to such factors as abrupt changes in temperature, settling of the building structure, or for various other well known reasons.

It has been a common practice to provide such building structures with flashing or weatherproofing systems designed to channel ambient liquid (e.g. rain, snow, etc.) away from the adjoining surfaces of these structural surfaces and to also allow ventilation of moisture trapped within the confines of the adjoining surfaces. Many known flashing systems employ a flexible (generally elastomeric) sheet of material which overlies one structural member (e.g. a roof deck) and which has a portion connected to some from of adjoining planar building member (e.g. a roof parapet).

In known flashing systems it is common to provide a bracket designed to support the sheet of elastomeric material in such a manner that the sheet of elastomeric material serves to channel ambient liquids away from the areas between the adjoining surfaces. At the same time the bracket also serves to mount the elastomeric material in such a manner that ambient moisture trapped by either of the structural surfaces can be vented to the atmosphere.

Examples of various known types of flashing systems are shown in U.S. Pats. Nos. 3,132,445, 3,410,038, 3,562,971, 3,488,902, 3,444,658, 3,686,803, 3,731,439, 3,793,795, 3,246,433, and 3,365,847. Additionally, an example of a molding for mounting stretched coverings from wall ceilings can be found in disclosures such as U.S. Pat. No. 3,719,013.

It is typical of many of the known forms of flashing systems that the sheet of elastomeric material is often initially wrapped about a longitudinally extending stiffening member, and the combined stiffening member and elastomeric material are then transversely inserted into a longitudinally extending bracket part which is supported from the building parapet. This type of flashing system can be found in such disclosures as U.S. Pat. Nos. 3,562,971 and 3,410,038. Installation of such flashing systems requires care on the part of the installer to make sure that the elastomeric material is properly wrapped about the stiffening member. Otherwise the elastomeric material and stiffening member are not properly retained within the bracket. In other known types of flashing systems the elastomeric material is manually draped over a structural portion of the bracket and then a cover member is disposed in covering relationship to the elastomeric member.

Experience has shown that in either of the foregoing types of flashing systems, more time than is desirable may be spent in properly installing the system. In the event that the flashing system is improperly installed it is necessary to remove either the cover or the combined elastomeric sheet and stiffening member and reinstall the member in the bracket. Also, where the position of the elastomeric sheet is to be adjusted, the elastomeric sheet must be removed and then reinstalled.

SUMMARY OF THE PRESENT INVENTION

The present invention provides a flashing system which is designed for easy and accurate installation relative to adjoining structural surfaces, and which also provides for ready adjustability of the position of the flashing system relative to the structural surfaces. The present invention simplifies installation of the present flashing system to the point where it virtually guarantees accurate disposition of the elastomeric material in its supporting bracket in a minimum of time.

According to the present invention a longitudinally extending bracket member is provided which is adapted to be secured to a structural surface such as a building parapet or the like. The bracket includes a longitudinally extending opening. A sheet of elastomeric material extends through the opening, and a stiffening member in the form of a longitudinally extendng planar member has a portion thereof fixedly secured to the sheet of elastomeric material. Part of the bracket member defines a longitudinally extending track portion designed to slidably and directly engage a longitudinal edge of the stiffening member. The combined elastomeric material and stiffening member are designed to be longitudinally inserted from one end of the bracket member with the stiffening member slidably engaging the track portion, and the bracket member also defines means which resists dislodgement of the stiffening member by movement of the stiffening member through the longitudinal opening.

In the preferred embodiment the stiffening member is formed of a material which has sufficient widthwise stiffness to support the weight of the sheet of elastomeric material without buckling. The stiffening member is also longitudinally flexible to conform to the shape of the adjoining surfaces.

DESCRIPTION OF THE DRAWINGS

The further objects and advantages of the present invention will become further apparent from the following detailed description taken with reference to the accompanying drawings wherein:

FIG. 2 is a top view of a surface of the elastomeric material and stiffening member;

FIG. 3 is a cross sectional view of a bracket member supporting a combined elastomeric material and stiffening member and taken from the direction 3—3 in FIG. 1; and FIG. 4 is a perspective view of another type of building roof structure incorporating a flashing system according to the present invention.

DETAILED DESCRIPTION OF THE PREFERRED EMBODIMENT

Figure 1:
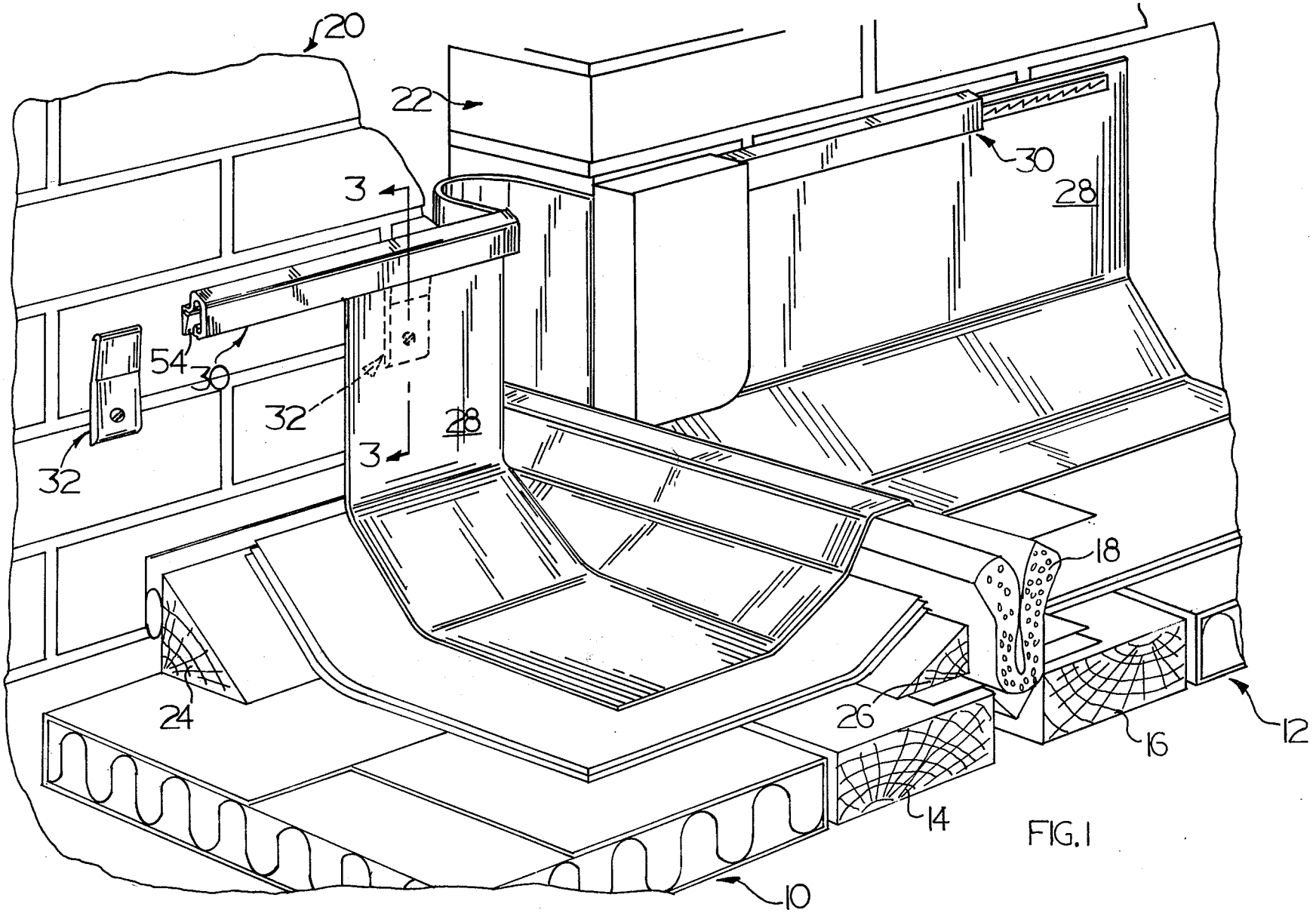
FIG. 1 is a perspective view of a portion of a building roof structure incorporating a flashing system according to the present invention.

As set forth above the present invention relates to a flashing system designed to provide a weatherproof covering to adjacent structural surfaces which are exposed to ambient conditions. In the description which follows the principles of the present invention are described in connection with a building roof system. However, from the following description the manner in which the principles of the invention can be applied to various structural surfaces will be readily apparent to those of ordinary skill in the art.

In FIG. 1 a building roof system includes a pair of horizontal deck sections 10, 12. Brace members 14, 16 are connected to the deck sections, and the brace members are interconnected by conventional means (not shown). In the illustrated embodiment a mass of insulation material 18 is disposed between the brace members 14, 16. A pair of parapets 20, 22 are formed as brick walls which extend vertically upward from adjacent the deck sections 10, 12. A wedge shaped member 24 is disposed between each roof deck and the adjoining parapet, and a wedge shaped member 26 is disposed between each roof deck and the insulation material 18.

The roof deck sections 10, 12 and their adjoining parapet sections are often subject to relative movement, due to factors such as building settling, temperature variations, etc. The flashing system of the present invention serves to weatherproof the junctions of the adjacent structural surfaces against ambient liquids (e.g. rain, snow, etc.) while allowing the structural surfaces to ventilate themselves.

Generally, the flashing system includes a sheet of flexible material 28 (preferably elastomeric) which is connected to a bracket member 30. Bracket member 30 is connected to one or more cleats 32 which are fixed to the walls of the parapets.

In FIG. 1 a single sheet of flexible material 28 is connected to a pair of brackets 30 which, in turn, are supported from the walls of parapets 20, 22. The sheet 30 hangs freely from brackets 30 and drapes across the roof deck sections 10, 12, the wedge shaped members 24, 26, the brcke members 14, 16 and the insulation material 18. The sheet of flexible material 28 serves to channel ambient liquid (e.g. rain, snow, etc.) away from the junctions of these surfaces. If desired, a conventional roof covering may be disposed over the flexible sheet, as is well known in the art.

A sheet of flexible material 28 is shown in FIG. 2. The sheet of material is preferably elastomeric, and in its simplest form is rectangularly shaped. The sheet 28 includes a longitudinally extending edge 34. A stiffening member 36 has a portion which is fixedly secured to flexible sheet 28. Stiffening member 36 is a longitudinally extending planar member having a pair of generally parallel longitudinal edges 38, 40. In the illustrated embodiment the stiffening member 36 is stitched to sheet 28 with longitudinal edges 38, 40 disposed in a predetermined spaced, generally parallel relation to edge 34 of the sheet.

Each bracket 30 is preferably formed as a longitudinally extending single piece of extruded metal (preferably aluminum) having a uniform cross section similar to that shown in FIG. 3. First and second longitudinally extending leg portions 42, 44 include respective first and second inner wall surfaces 45, 46 which are disposed in generally facing relationship to each other. A longitudinally extending lip member 48 is disposed between leg portions 42, 44. Lip member 48 includes a first wall portion 50 which faces first inner wall 45, and a second wall portion 52 which faces second inner wall 46 and in combination therewith defines a longitudinally extending opening 54 in the bracket. The bracket 30 further includes a longitudinal top member 56 which joins longitudinal first ends of the leg portions 42, 44.

A member 58 connects lip member 48 to a longitudinal second end of the leg portion 42. Member 58 includes a track surface 60 connecting wall portions 42 and 50. As seen in FIG. 3 the longitudinal distal edge 62 of lip 48 is spaced from the inner wall 64 of end member 56 by a distance *d* which is less than the distance D from sheet edge 34 to the edge 40 of the stiffening member.

In assembling the combined sheet 28 and stiffening member 36 with the bracket 30, the sheet and stiffening member are inserted through a longitudinal end of the bracket with edge 40 of stiffening member 36 slidably engaging track surface 60 and elastomeric sheet 28 extending through longitudinal opening 54 in the bracket in the manner shown in FIG. 3.

First inner wall surface 45, first wall portion 50 and track surface 60 combine to define a longitudinally extending track. The edge of the stiffening member slidably engages the track surface 60 and the track serves to guide the stiffening member for substantially longitudinal movement relative to the bracket. This allows the elastomeric material to be easily inserted into engagement with the bracket and to be easily moved into any desired longitudinally relationship with the bracket.

Referring specifically to FIGS. 2 and 3 the distance D from the edge 40 of the stiffening member to the longitudinal edge 34 of the sheet (or to the closest point of the longitudinal edge 34 of the sheet in the event the longitudinal edge of the sheet and the stiffening member edge are not precisely parallel) is designed to be greater than the distance *d* between the distal end of the lip member and the inner wall surface 57 of the top member 56. Additionally, the width of the stiffening member is preferably greater than the shortest distance between the second wall portion 52 of the lip and the second inner wall surface 46. Also, the widthwise stiffness of the stiffening member is preferably such that when it engages the bracket member in the manner set forth above it resists widthwise buckling of the stiffening member under the weight of the sheet of elastomeric material. According to the preferred embodiment the stiffening member is preferably formed of plastic, for example Mylay - a polyester film.

Once the combined elastomeric sheet and stiffening member have been longitudinally inserted into a desired position relative to the bracket member 30 the bracket member is then mounted on the cleats 32. Each cleat 32 includes a substantially planar portion 66 which is fixed to a parapet wall 68 and a portion 70 which extends angularly outward relative to the parapet wall. The angular portion includes an inclined edge 72 and a locking edge 74. The bracket inner wall surface 46 is also preferably wedged shaped with a locking edge 76. Insertion of the bracket member with the cleat is generally in a downward direction in FIG. 3 and brings the locking edges 74, 76 into engagement with each other in the manner illustrated.

As shown in FIG. 4 when the principles of the present invention are used to provide a flashing system which weatherproofs both the junctions between a pair of adjacent parapets 78, 80 with each other and with a roof deck 82 a single sheet 84 of elastomeric material may be supported by a pair of bracket members 86, 88, each of which is supported in the manner set forth above from a respective parapet wall. The stiffening member is shown at 89. The stiffening member is longitudinally flexible and can be bent to conform to adjacent structural surfaces. In addition, the stiffening member is also resilient enough to return to its original set when it is removed from such a bent condition.

Also, as shown in FIG. 4 depending upon the shape of the adjacent surfaces which are to be covered by the flashing system the single sheet of material may include appropriate slots 90 or other configurations which allow it to conform to the various shapes of the adjacent surfaces. In addition, as illustrated in FIG. 4 a cover piece 92 may be provided which is generally snapped over one or more of the bracket members.

Referring again to FIG. 3, and as noted above, the maximum distance from the edge 40 of the stiffening member to the longitudinal edge 34 of the elastomeric sheet is such that when the members are assembled with the bracket the longitudinal edge 34 of the sheet forms a gap 94 with the inner wall surface 57. The bracket ends are not closed, and during movement between a building parapet and a respective portion of a roof deck moisture which is trapped within portions of the roof deck can move between the sheet of elastomeric material and the parapet and escape to the atmosphere through gap 94 and the open ends of the bracket. Thus, the present invention provides for ventilating the area between the roof deck and the parapet while preventing seepage of ambient liquid into this area.

In summary, the present invention provides a flashing system which is extremely effective at weather proofing adjoining structural surfaces against ambient liquid on which is also designed to ventilate moisture trapped between the surfaces. The present invention accomplishes this function by means of a structure which is easily assembled and disassembled, and which is readily adjusted with minimum potential for inaccurate disposition of the flashing system, and in a minimum of time.

With the foregoing description in mind many and varied applications of the principles of the present invention will become readily apparent to those of ordinary skill in the art.

What is claimed is:

1. Apparatus comprising a longitudinally extending bracket member adapted to be secured to at least one of a plurality of adjoining structural surfaces which are exposed to ambient conditions, said bracket including means forming a longitudinal opening, a sheet of flexible material extending partially through said longitudinal opening, said sheet of flexible material being supported by said bracket member with a portion thereof disposed to cover a predetermined portion of said adjoining structural surfaces, a stiffening member comprising a longitudinally extending planar member having a portion thereof fixedly secured to said sheet of flexible material, said bracket member defining longitudinally extending track means for slidably engaging a portion of said stiffening member for supporting and for guiding said stiffening member and said sheet of flexible material for sliding movement in generally longitudinal directions relative to said bracket member, said bracket member further defining means for resisting dislodgement of said stiffening member from said bracket by movement of said stiffening member through said longitudinal opening.

2. Apparatus as set forth in claim 1 wherein said longitudinally extending planar member includes a pair of substantially parallel longitudinal edges, said longitudinally extending planar member being fixedly secured to said flexible sheet with said longitudinal edges disposed in predetermined spaced relation to an edge of said flexible sheet, said longitudinally extending planar member being disposed with respect to said bracket with one of said longitudinal edges in sliding engagement with said track means.

3. Apparatus as defined in claim 2 wherein said longitudinally extending planar member is formed of a material havng a widthwise stiffness capable of supporting a predetermined amount of the weight of said sheet of flexible material without itself buckling.

4. Apparatus as defined in claim 3 wherein said longitudinally extending planar member is longitudinally flexible to allow it to be shaped to conform to the shapes between adjoining structural surfaces.

5. Apparatus comprising a longitudinally extending bracket member adapted to be secured to at least one of a plurality of adjoining structural surfaces which are exposed to ambient conditions, said bracket member comprising a first longitudinally extending leg member having a first inner wall surface, a second longitudinally extending leg member having a second inner wall surface disposed in substantially spaced facing relationship to the inner wall surface of said first leg member, a longitudinally extending top member connecting a longitudinal edge of said first leg member with a longitudinal edge of said second leg member and having a third inner wall surface connecting said first and second inner wall surfaces, a longitudinally extending lip member disposed between said first and second leg members and having a first wall portion disposed in spaced facing relationship with said first inner wall surface and a second wall portion in substantially spaced facing relationship with a portion of said second inner wall surface and defining therewith said longitudinally extending opening in said bracket member, said track means including track surface means connecting a first longitudinally extending portion of said first inner wall surface with a first longitudinally extendig portion of said first wall portion, a sheet of flexible material extending partially through said longitudinally extending opening, said sheet of flexible material having a longitudinally extending edge portion, a stiffening member comprising a longitudinally extending planar member having first and second longitudinally extending edge portions, means for fixedly securing a portion of said longitudinally extending planar member to said sheet of flexible material with said first longitudinal edge portion disposed in substantially parallel relationship with said longitudinal edge portion of said sheet of flexible material, said first edge portion of said longitudinally extending planar member slidably engaging said track surface means of said bracket member, said third inner wall surface of said bracket member including a portion which is spaced from said lip member by a distance which is less than the distance from said first longitudinal edge of said stiffening member to said longitudinal edge of said sheet of flexible material, said first second and third inner wall surfaces said first and second wall portions and said track surface means being effective to resist dislodgement of said stiffening member through said longitudinal opening.

6. Apparatus as defined in claim 5 wherein said first and second longitudinally extending edge portions of said longitudinally extending planar member are substantially parallel to each other and are spaced from each other by a distance which is greater than the maximum distance between said second inner wall surface and said second wall portion.

7. Apparatus as defined in claim 5 wherein said third wall surface includes a portion which faces said track surface and is spaced therefrom by a distance which is greater than the distance from said first longitudinal edge portion of said longitudinally extending planar member to said longitudinal edge portion of said sheet of flexible material.

8. Apparatus as defined in claim 5 further including a cleat member adapted to be fixedly secured to one of the adjoining structural surfaces and having a locking surface angularly disposed with respect to the one structural surface, said second leg member of said bracket being generally wedge shaped and having a locking surface which is engagable with the locking surface of said cleat member to support said bracket member from the one of said adjoining structural surfaces.

* * * * *